US006773010B2

(12) United States Patent
Zucchi et al.

(10) Patent No.: US 6,773,010 B2
(45) Date of Patent: Aug. 10, 2004

(54) GAME TABLE SURFACE

(75) Inventors: Jeffrey R. Zucchi, Evansville, IN (US); James R. Allshouse, Newburgh, IN (US)

(73) Assignee: Indian Industries, Inc., Evansville, IN (US)

( * ) Notice: Subject to any disclaimer, the term of this patent is extended or adjusted under 35 U.S.C. 154(b) by 0 days.

(21) Appl. No.: 10/095,254

(22) Filed: Mar. 11, 2002

(65) Prior Publication Data

US 2003/0168801 A1 Sep. 11, 2003

(51) Int. Cl.[7] ..... A63F 7/07

(52) U.S. Cl. ..... 273/108.1; 273/126 A; 273/108.52; 273/DIG. 26

(58) Field of Search ..... 273/118 R, 118 A, 273/126 R, 126 A, 108.1, 108.5, 108.51, 108.52, 108.53, 108.54, 108.55, 108.56, DIG. 26; 40/611, 605, 615; 473/29, 115, 481

(56) References Cited

U.S. PATENT DOCUMENTS

| | | | | | |
|---|---|---|---|---|---|
| 3,571,959 | A | * | 3/1971 | Babcock | 40/615 |
| 3,887,187 | A | * | 6/1975 | Crossman et al. | 273/126 A |
| 3,926,432 | A | | 12/1975 | Furr et al. | |
| 4,025,073 | A | | 5/1977 | Furr et al. | |
| 5,010,672 | A | * | 4/1991 | Coleman | 40/615 |
| 5,011,147 | A | * | 4/1991 | Thomas et al. | 273/126 A |
| 5,443,869 | A | * | 8/1995 | Harris | 428/13 |
| 5,630,760 | A | | 5/1997 | Brown et al. | |
| 5,709,385 | A | | 1/1998 | Fitzpatrick et al. | |
| 5,988,636 | A | | 11/1999 | Kilmer | |
| 6,007,437 | A | * | 12/1999 | Schickert et al. | 473/481 |
| 6,234,476 | B1 | | 5/2001 | Yamashita et al. | |
| 6,276,682 | B1 | * | 8/2001 | Yamashita et al. | 273/126 A |
| 6,279,905 | B1 | * | 8/2001 | Malavazos et al. | 273/126 A |
| 2003/0168801 | A1 | * | 9/2003 | Zucchi et al. | 273/126 R |

* cited by examiner

*Primary Examiner*—Raleigh W. Chiu
(74) *Attorney, Agent, or Firm*—Woodard, Emhardt, Moriarty, McNett & Henry LLP

(57) ABSTRACT

The present invention includes a game table for use in a game such as hockey or soccer. The table includes a table bed having an upper support surface. A game surface is mounted on said upper support surface and has an upper playing surface upon which the game is played. As one feature of the present invention, at least one game status indicator is mounted to the table with a display face indicating game statistics such as the score or time. In one embodiment the display face is visible through the game surface which defines at least one transparent section over the game status indicator. In an alternate embodiment, the game indicator display surface is mounted flush with the upper playing surface. The game surface has a thickness separating an upper playing side and a lower side. Graphic decorations are printed between the lower side of the game surface and the upper support surface of the table bed. In one method of printing, a first layer of graphic decoration is reverse printed on the lower side of the game surface, and a second layer of graphic decoration is reverse printed over the first layer of graphic decoration. In certain preferred embodiments, the upper playing side of the game surface may be textured, for example with dimples, stripes, random lines, or similar indicia to simulate uneven ground conditions.

12 Claims, 6 Drawing Sheets

GAME TABLE SURFACE

FIELD OF THE INVENTION

The present invention relates generally to game tables, and more particularly to an improved surface and scoring display for game tables such as for hockey or soccer.

BACKGROUND OF THE INVENTION

Watching and participating in sporting events and games is a popular pastime for many people. However, due to time, space and the number of people needed for most such games, it is not always practical to arrange a full-scale game at any particular time. Moreover, due to the skill and physical conditioning required, plus the potential injuries from many such games, individuals are not always prepared to participate in a full-scale game. As a spin-off from full-scale games, recreational game tables such as for table soccer (sometimes called foosball), air hockey or field hockey have become popular. Game tables allow the participants to simulate a full-sized game with fewer people, less space and in a protected environment. Such games can, for example, be set up in basements, garages, game rooms, backyards, gyms, party facilities or otherwise and are often played with two or four people.

There have been various approaches to designing and constructing game tables for table soccer, air hockey, field hockey, and similar games. One desired goal of such games is to imitate the play of the actual game as closely as possible. The playing surface is an important factor contributing to the simulation of an actual game. Typical designs for playing surfaces have included a flat surface, for example made of wood or metal, upon which the game graphics are printed. However, completely smooth playing surfaces do not necessarily simulate the playing conditions of an actual game. Moreover, after and during use many table surfaces are damaged by impacts, spills or similar wear and tear such that the surface is irregular and the game graphics are damaged or erased to the extent that the playing surface may become unusable. Accordingly there is needed an improved game table playing surface which is more realistic and which addresses the problem of potential damage.

Additionally, often when playing these games, each team's score from point to point is merely remembered by each player along with the time elapsed or remaining as corresponds with the game. Although usually a reliable system, if a player is distracted or the player's concentration is broken, it may lead to the player mis-remembering the score or forgetting a time period. Conversely, if a player is concentrating on the score or time, it may distract the player's attention from the game in progress. In the past, attempts to display the score and time for similar games have involved bulky and/or complex manual or electric components located above or adjacent the table. Such displays frequently take additional space, interfere with a clear view of the table and/or require the player to look away from the playing surface in order to view the display. This can distract players and interfere with game play. Accordingly, there is a need for an improved method of keeping and illustrating the score and time periods for table games.

The present invention addresses these needs, among others.

SUMMARY OF THE INVENTION

One preferred embodiment of the present invention includes a game table for use in a game such as hockey or soccer. The table includes a table bed having an upper support surface. A game surface is mounted on said upper support surface and has an upper playing surface and playing area within which the game is played. As one feature of the present invention, at least one game status indicator is mounted to the table with a display face indicating game statistics such as the score or time. In one embodiment the game status indicator is mounted below the playing surface with the display face visible through the game surface which has a transparent section over the game status indicator. In an alternate embodiment, the game indicator display surface is mounted flush with the upper playing surface.

In another feature of certain preferred embodiments of the present invention, a game table includes a table bed defining an upper support surface. A game surface is mounted to the upper support surface, and is configured to substantially cover the upper support service. The game surface has a thickness separating an upper playing side and a lower side. Graphic decorations are printed between the lower side of the game surface and the upper support surface of the table bed. In one method of printing, a first layer of graphic decoration is reverse printed on the lower side of the game surface, and a second layer of graphic decoration is reverse printed over the first layer of graphic decoration. In a further feature of certain preferred embodiments, the upper playing side of the game surface may be textured, for example with dimples, stripes, random lines, or similar indicia to simulate uneven ground conditions.

It is an object of the present invention to provide an improved game table assembly.

It is a further object of the present invention to provide a game table assembly with an improved game status display.

It is a further object of the present invention to provide a game table assembly with an improved game playing surface.

These and other objects and advantages of the present invention will be apparent from the following description of the preferred embodiments.

DESCRIPTION OF THE PREFERRED EMBODIMENTS

Figure 1:
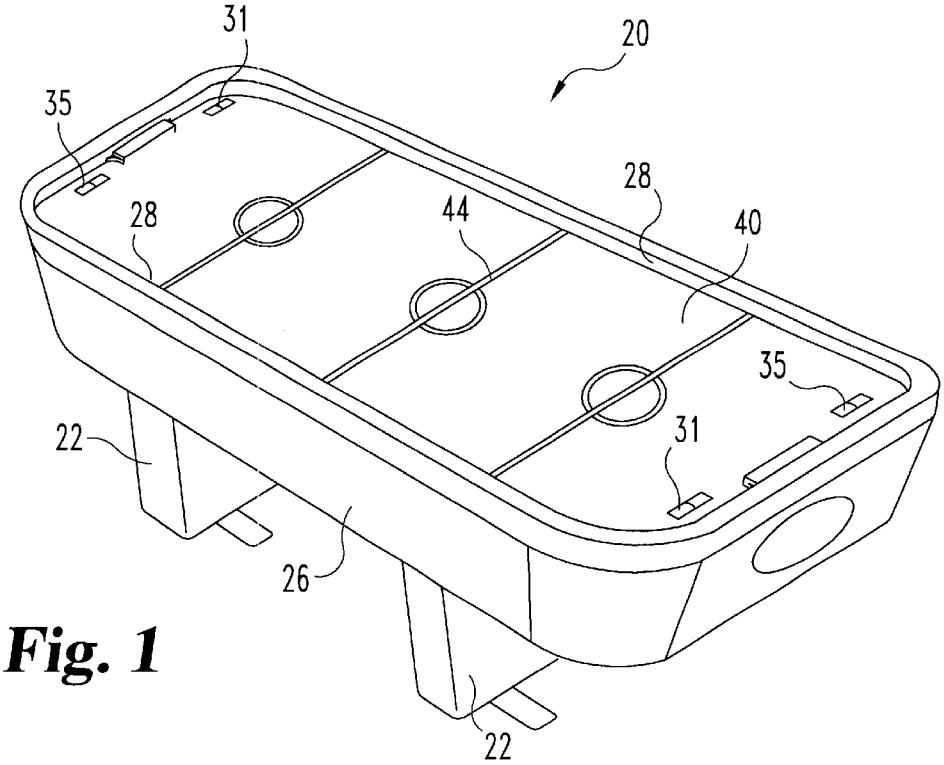
FIG. 1 is a perspective view of a game table according to one preferred embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

In preferred embodiments of the present invention a game table, and method of making it, are provided with improved playing characteristics. The game table is preferably for use with table games such as soccer (also called foosball), ice or field hockey and/or air hockey. In preferred features of the present invention a game playing surface is provided with improved durability and characteristics simulating real playing surfaces. As a separate preferred feature, the tables include game status indicators, such as score indicators and timers, with enhanced visibility and accessibility to the player while minimizing any obstruction or distraction.

Figure 2:
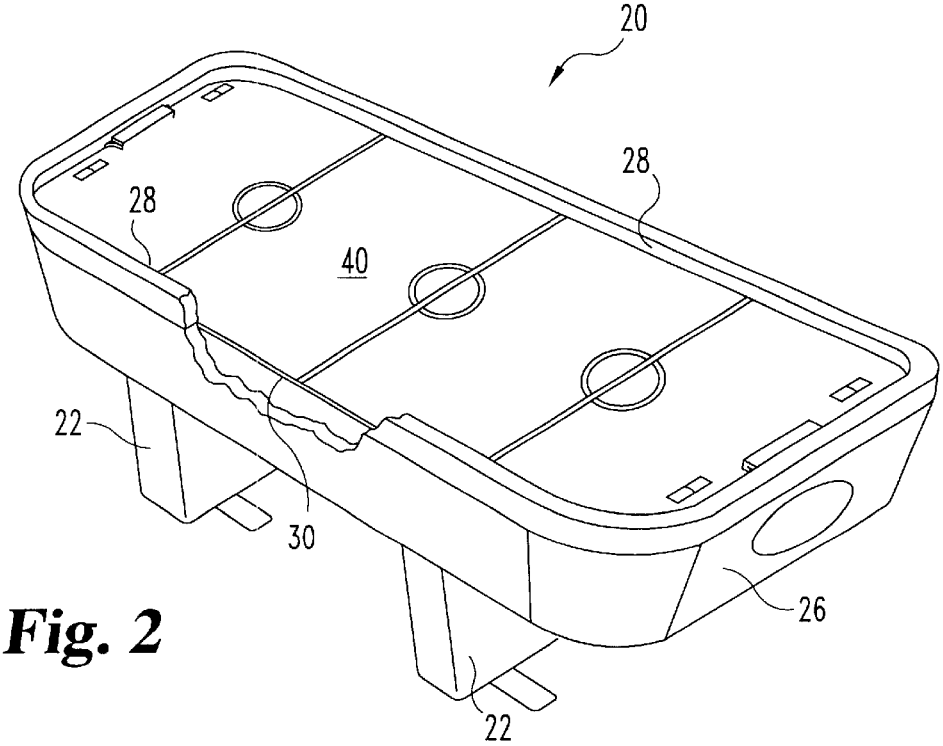
FIG. 2 is a partially cut-away, perspective view of the game table of the embodiment of FIG.1.
Figure 3:
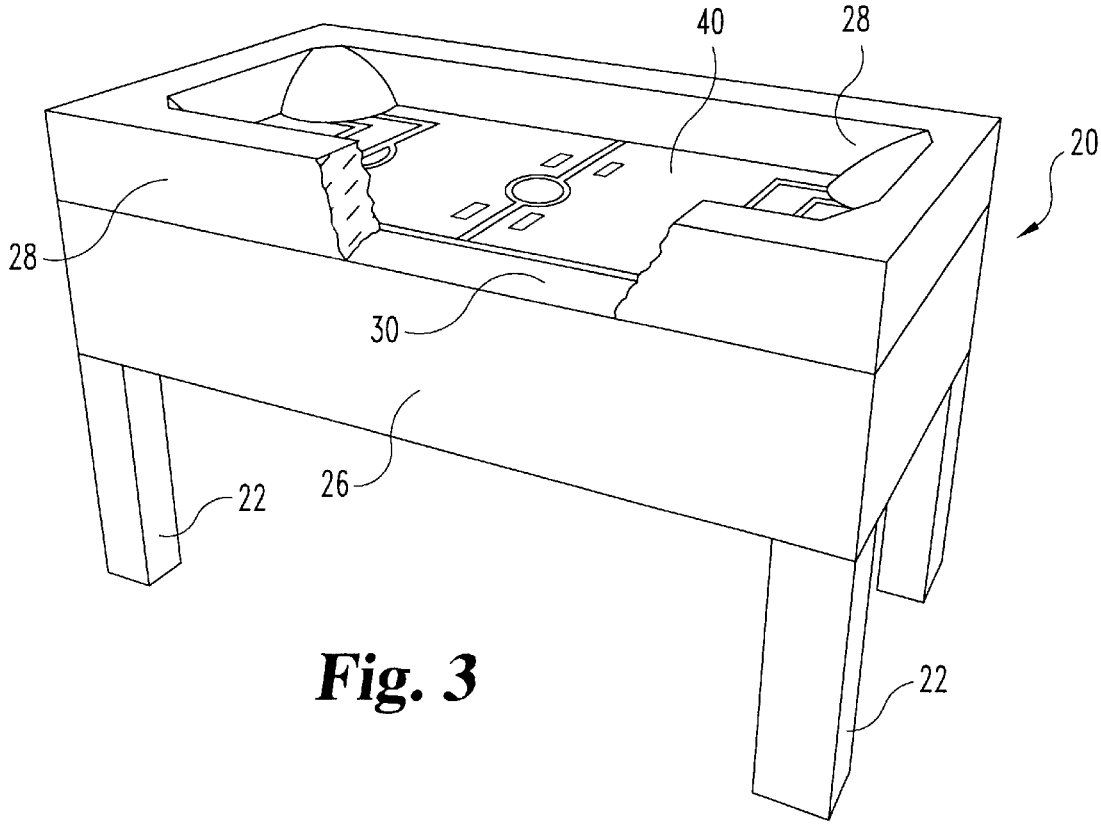
FIG. 3 is a perspective view of an alternate embodiment of a game table.

Preferred embodiments of an air hockey table 20 and a soccer table 20' are illustrated in FIGS. 1–3. Game table 20 is generally a standard style of game table including legs 22 supporting a polygonal table bed 26. Table bed 26, shown in FIGS. 1–3 in a generally rectangular shape, is the primary superstructure of game table 20. Legs 22 are standard support structures for a table, and may, for example, be four corner legs or one or more central pedestals supporting the table bed 26. In preferred embodiments, table 20 includes a frame or railing 28 mounted to the table bed 26. Frame 28 surrounds and extends above an upper support surface 30 a height sufficient to block escape of a playing piece from the table. Typical heights can be from ¾" to six or more inches as a design choice for a particular game. Frame 28 can be a standard frame made of metal, wood, laminate, particleboard, MDF or plastic, or can alternately include rubber or felt bumpers as desired.

Game playing surface 40 has a polygonal shape matching upper support surface 30 and is configured to be mounted to table bed 26. The game playing surface 40 extends across the area defined within frame 28 to form a playing area. The game playing surface is mounted to the frame 28 or extends underneath the lower edges of frame 28 to eliminate gaps. Playing surface 40 may rest in place or can be attached using standard methods such as adhesive, friction, screws, bolts or other permanent or removable connectors. Playing surface 40 is appropriately sized and configured for the desired game, for example with air holes aligned with air ducts (not shown) in support surface 30 for an air hockey game.

Figure 4:
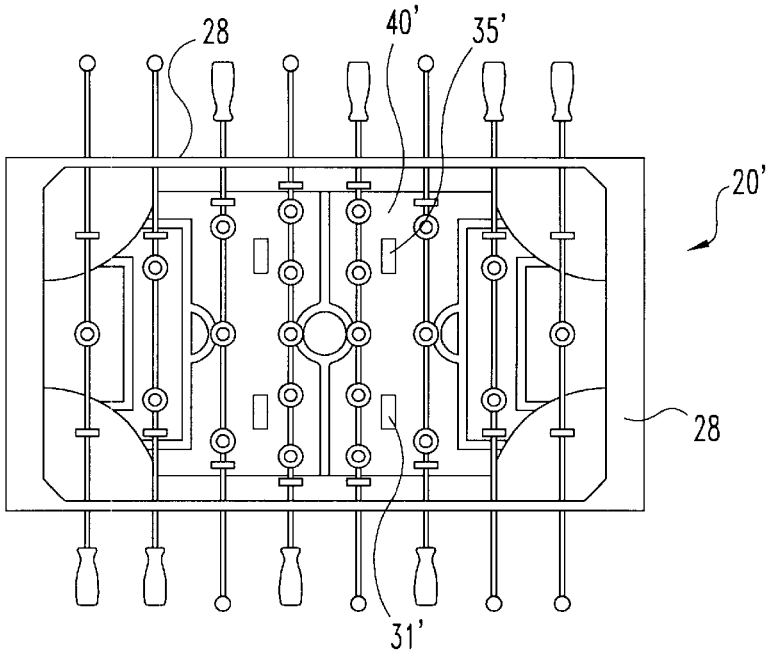
FIG. 4 is a top view including cross-bars and game figures of an alternate preferred embodiment of the game table of FIG. 3.

A similar structure is illustrated in FIGS. 3 and 4 for a soccer game table 20', including in FIG. 4 illustrations of cross-bars with mounted soccer players. The soccer table 20' has a basic support structure and a table bed as previously described and understood in the art and includes game surface 40'. Game surface 40' has a generally polygonal shape, but may include semicircular shaped corner cut-outs or contoured portions which cover, create or allow clearance for corner ramps commonly used in certain game tables to prevent the playing ball from stopping outside the effective playing area. The discussion herein of game table 20 generally applies to game table 20' as well.

Further illustrated in FIGS. 1 and 2 are game status indicators, such as score display 31 and timer display 35 mounted to game table 20. Preferably, as discussed in detail below, the game status indicators are mounted in the interior of the playing area. To be visible without interfering with play, the display face of each indicator is embedded in the table flush with the playing surface or below transparent portions of the playing surface.

Figure 5:
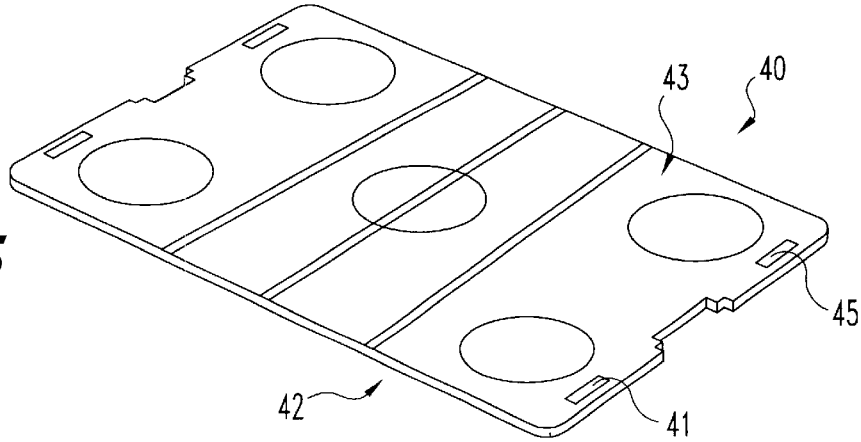
FIG. 5 is a perspective view of a game table playing surface usable in the embodiment of FIG. 1.
Figure 6:
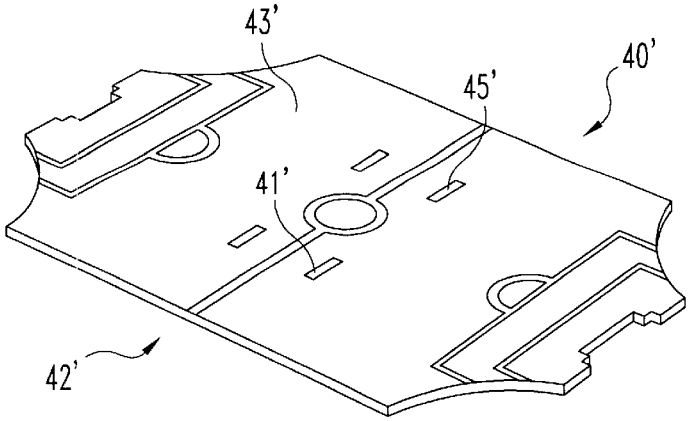
FIG. 6 is a perspective view of a game table playing surface usable in the embodiment of FIG. 3.

FIGS. 5 and 6 illustrate perspective views of game surfaces 40 and 40'. Game surface 40 could be used, for example in the table illustrated in FIGS. 1 and 2, and game surface 40' could be used, for example in the table illustrated in FIGS. 3 and 4. Table surfaces 40 and 40' are preferably polygonal shaped pieces of material configured to be mounted over a table upper support surface 30. Preferred materials for the game surfaces are a durable plastic (such as a thick polyethylene or Plexiglass®) or glass, capable of being transparent in at least portions and also capable of being semi-transparent in portions, colored, tinted and/or printed upon. Game surfaces 40 and 40' preferably have a thickness separating an upper playing surface 43 or 43' from a lower surface 42 or 42'. Display locations 41 and 41' and 45 and 45' are defined in table surfaces 40 or 40' and located to be aligned with score displays and/or timers when the table surfaces are in place in a game table.

Figure 7A:
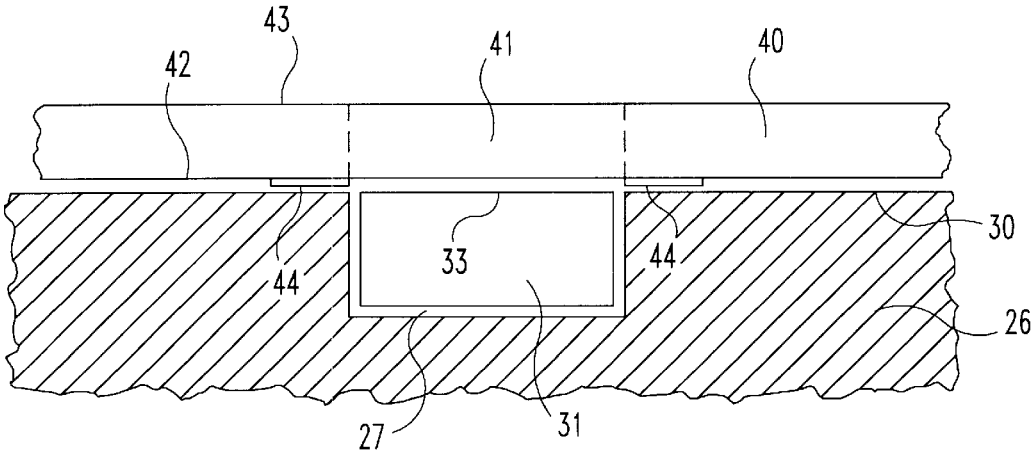
FIG. 7A is a side view of a game status indicator mounted in a game bed.

Shown in an enlarged, side view in FIG. 7A is a game status indicator such as score display 31 or timer 35 embedded in support surface 30 (sizing and spacing are exaggerated for clarity). In this embodiment, table bed 26 preferably has one or more removed portions or openings 27 into which each game status indicator 31 or 35 is mounted. Each status indicator preferably has an upper, display face 33 which is oriented to be below a display location 41 or 45 of playing surface 40. Game playing surface 40 is mounted over support surface 30 and display face 33. Game playing surface 40 has at least one transparent portion at display location 41 aligned over each display face 33. Display face 33 of the game status indicator may be flush with support surface 30 or may extend slightly to fit into a matching recess in playing surface 40 (not shown). In certain embodiments, graphical decorations (including text or artwork) are printed adjacent status display face 33, for example by a printed layer 44 between lower side 42 of game playing surface 40 and support surface 30. Appropriate wiring (not illustrated) from each status indicator extends to a central controller and a power supply.

Figure 7B:
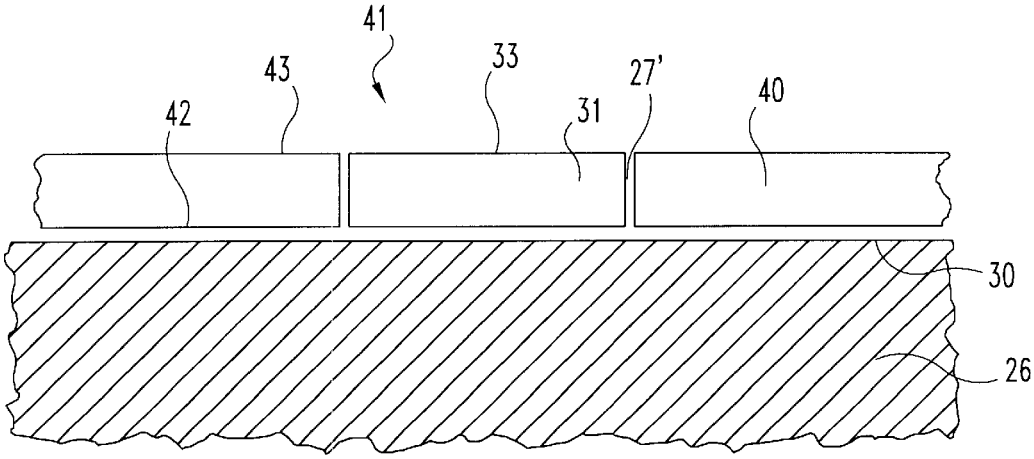
FIG. 7B is a side view of a game status indicator mounted flush with the game playing surface.

In an alternate embodiment, illustrated in FIG. 7B, the display face 33 of the game status indicator is mounted flush with the upper playing surface 43 at display location 41. In this embodiment, an opening 27' is made in the playing surface 40 to receive the game status indicator 31. Preferably, display face 33 is received snugly into the opening 27' in playing surface 40 to minimize any gap or irregularity across upper playing surface 43. Preferably in this embodiment, display face 33 has a texture matching the texture of upper playing surface 40.

Figure 7C:
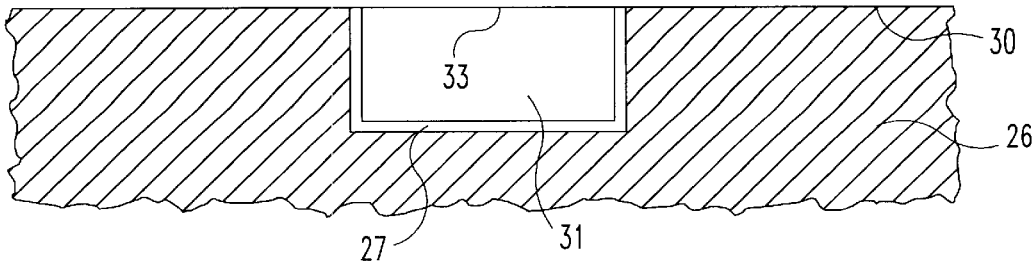
FIG. 7C is a side view of an alternate embodiment of a game status indicator mounted in a game bed.
Figure 8A:
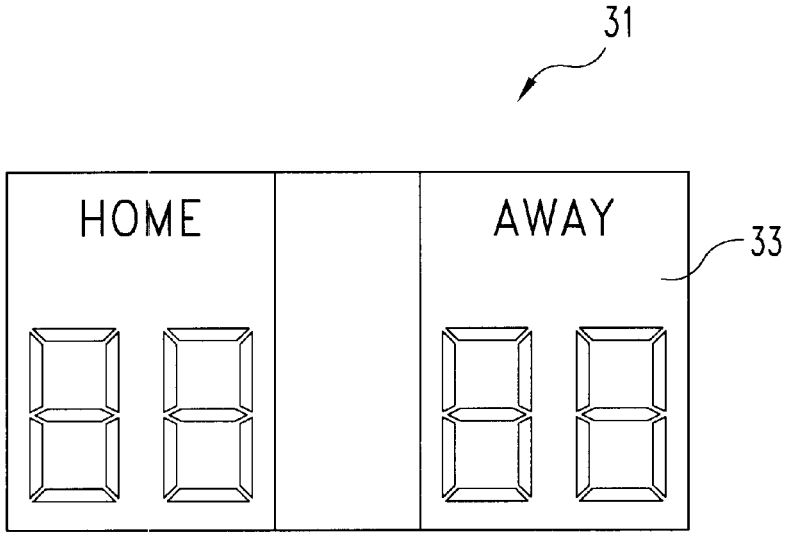
FIGS. 8A and 8B are top views of game status indicators.
Figure 8B:
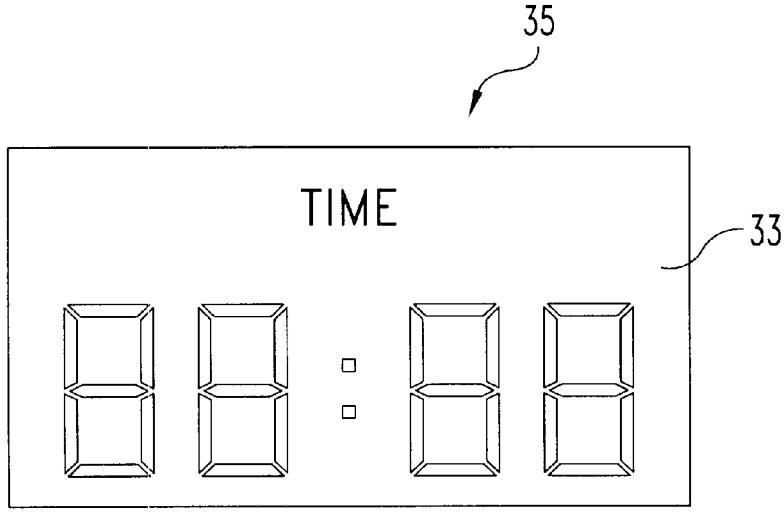
Figure 9:
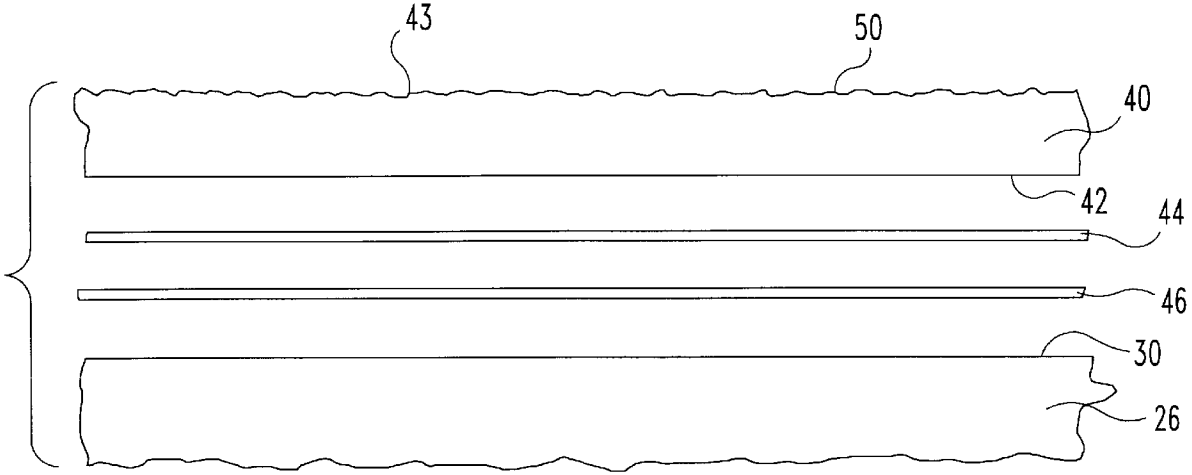
FIG. 9 is a side, exploded view of the construction of a game playing bed.
Figure 10D:
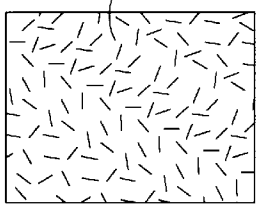
FIGS. 10A–D are partial top views of textures for a game table playing surface.
Figure 10C:
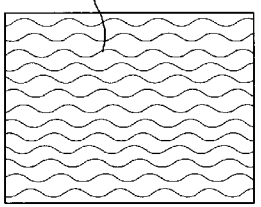
Figure 10B:
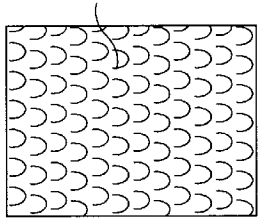
Figure 10A:
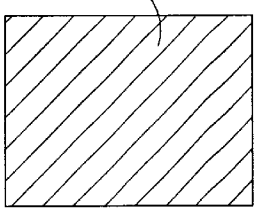

In a further embodiment shown in FIG. 7C, the game status indicator is embedded in the table bed 26 flush with support surface 30 without a separate playing surface 40. In this less preferred embodiment, support surface 30 is also the upper playing surface.

Top views of display face 33 of score indicator 31 or timer 35 are shown in FIGS. 7C and 7D. Each game table has at least one game status indicator, and preferably has a plurality. Game status indicators can be mounted in various locations as desired for visibility with minimal distraction. In one preferred embodiment, game status indicators are mounted adjacent opposing ends of game table 20 for the convenience of each player (FIGS. 1 and 2). In an alternate embodiment, the game status indicators are located adjacent the center of the table (FIGS. 3 and 4). More than one status indicator can be mounted at each end to display, for example the score, the period, the time elapsed or remaining time in the period and similar game statistics. Depending on the desired complexity of the game and desired size of the display, other game statistics such as possession of the ball or puck, team names, fouls, high scores, scoring records, etc. can be displayed.

In a preferred embodiment, each game status indicator is electronic, displaying information using LED, LCD or similar technology. Preferably sensors (not shown) are positioned in scoring locations on the game table, and, when activated, automatically send score signals to a controller mounted within the table. The controller then forwards the appropriate signals to the game status indicators for display. Although less preferred, status indicators could also be mechanically or manually driven or activated. In preferred embodiments, status indicators and the controller also include manual controls for on/off power, starting, stopping or pausing a game or for manually adjusting a desired score.

Further features of preferred embodiments of the present invention are illustrated in FIGS. 9 and 10A–10D. As discussed, table bed 26 has a support surface 30 upon which game playing surface 40 is mountable. Graphical decoration layers 44 and 46 are printed between table bed 26 and playing surface 40. Printing the decorations below the playing surface 40 enhances the durability of the decorations and prevents them from being damaged, for example from rubbing, scoring or spills.

Graphical decorations can be text, game indicia such as lines or circles or decorative artwork. In one preferred method of assembly, graphical decorations include a first layer 44 printed on the lower side 42 of playing surface 40. This first layer 44 includes reverse-printed text and game indicia such as lines and circles. A second layer 46 is reverse printed on the lower side 42 of playing surface 40 over first layer 44 and is visible in the areas where first layer 44 is not printed. Second layer 46 may, for example, be a solid background color such as white or green or a simulated texture such as grass. For enhanced realism or decorative effect, the playing surface can be tinted, colored and/or can be semi-transparent in portions.

In an alternate preferred method of assembly, first layer 44 is reverse printed on lower side 42 of playing surface 40 while second layer 46 is positively printed directly on support surface 30. In another preferred method of assembly, background layer 46 is first positively printed on support surface 30 and first or foreground layer 44 is then printed over background layer 46. In a still further but less preferred embodiment, first layer 44 is the only layer, including both foreground and background graphical decorations and color.

In many game tables a smooth playing surface is desired. However, as an additional feature in certain preferred embodiments, upper side 43 of playing surface 40 may be textured to simulate a realistic playing surface. Examples of non-smooth textures are illustrated in FIGS. 10A–10D, including stripes 52, upward or downward dimples 54, waves 56 or random markings 58. The texture may be imparted to the material during formation, for example in making a molded or pressed plastic piece, or it may be added later, for example by a press, scoring or etching.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A soccer game table, comprising:

a) a soccer table having, b) a table bed defining a soccer playing surface and opposing ends;

c) a plurality of cross-bars mounted with mounted soccer players to said table;

d) opposing scoring locations defined said at opposing ends;

e) at least one recess defined in said table bed; and, f) at least one game status indicator embedded in said recess;

g) wherein said game status indicator has a display face mounted substantially flush with said playing surface and viewable from above the playing surface.

2. The soccer game table of claim 1, wherein said at least game status indicator is snugly embedded in said recess.

3. The soccer game table of claim 2 wherein said display has a texture matching the texture of said playing surface.

4. The soccer game table of claim 1, comprising at least two game status indicators embedded in recesses in said table bed.

5. The soccer game table of claim 4, wherein said two game status indicators are mounted adjacent opposing ends of said soccer table.

6. The soccer game table of claim 1, comprising at least four game status indicators embedded in recesses in said table bed, wherein a pair of game status indicators is mounted adjacent each opposing end of said soccer table.

7. An air hockey game table, comprising:

a) an air hockey table having a game playing surface;

b) a table bed with a support surface;

c) a game surface layer mounted over said support surface, said game playing surface being the upper surface of the game surface layer;

d) at least one game status indicator embedded within said game surface layer, e) wherein said game playing surface defines a playing area and said at least one game status indicator is mounted with the display face within the interior of said playing area;

f) said game status indicator including a display face oriented substantially parallel to said game playing surface; and, g) said game status indicator being mounted to position the height of said display face equal to or below said game playing surface.

8. The air hockey table of claim 7, wherein said display face is flush with said game playing surface.

9. The air hockey table of claim 7, wherein said display face is mounted below said game surface layer and said game surface layer defines a transparent portion vertically aligned with the display face of said game status indicator.

10. The air hockey table of claim 9, wherein the remainder of said game surface layer is semi-transparent.

11. The air hockey table of claim 7, wherein said game status indicator is mounted adjacent an end of the table.

12. The air hockey table of claim 6, wherein a pair of game status indicators are mounted adjacent an end of the table.

* * * * *

UNITED STATES PATENT AND TRADEMARK OFFICE

CERTIFICATE OF CORRECTION

PATENT NO. : 6,773,010 B2
DATED : August 10, 2004
INVENTOR(S) : Zucchi et al.

It is certified that error appears in the above-identified patent and that said Letters Patent is hereby corrected as shown below:

Column 6,
Line 63, replace “6” with -- 11 --.

Signed and Sealed this

Twenty-eighth Day of September, 2004

JON W. DUDAS
*Director of the United States Patent and Trademark Office*